United States Patent [19]

Levy et al.

[11] Patent Number: 4,831,857

[45] Date of Patent: May 23, 1989

[54] MACHINE WITH QUICK DISCONNECT BETWEEN SPINDLE DRIVE TRAIN AND POWER TRANSMISSION

[75] Inventors: Roger Levy, Bloomfield Hills; Everett Gleason, South Lyon, both of Mich.

[73] Assignee: Tishken Products Co., Detroit, Mich.

[21] Appl. No.: 169,961

[22] Filed: Mar. 18, 1988

[51] Int. Cl.[4] ..... B21D 5/14

[52] U.S. Cl. ..... 72/181; 72/226; 72/238; 74/405; 192/85 CA

[58] Field of Search ..... 72/181, 226, 239, 238, 72/234; 74/405; 192/85 CA, 96

[56] References Cited

U.S. PATENT DOCUMENTS

| | | | |
|---|---|---|---|
| 2,011,686 | 8/1935 | Mikaelson et al. | 72/239 |
| 2,248,088 | 7/1941 | Kane | 72/181 |
| 2,870,664 | 1/1959 | Lobkowitz | 72/239 |
| 3,456,472 | 7/1969 | Balfanz, Jr. | 72/181 |
| 4,482,039 | 11/1984 | Harris | 192/85 CA |
| 4,557,129 | 12/1985 | Lash et al. . | |
| 4,633,742 | 1/1987 | Gutowski et al. . | |
| 4,724,695 | 2/1988 | Stoehr | 72/181 |

FOREIGN PATENT DOCUMENTS

| | | | |
|---|---|---|---|
| 68224 | 4/1982 | Japan | 72/181 |
| 212812 | 12/1983 | Japan | 72/181 |
| 47025 | 3/1984 | Japan | 72/181 |
| 1399907 | 7/1975 | United Kingdom | 72/181 |

OTHER PUBLICATIONS

Advertisement of Yoder Manufacturing of 26800 Richmond Rd., Bedford Heights, Oh 44146, entitled "QVW Series Rollformer", (2—5—87).

Catalogue of Tishken Products Comapny of 13000 W. Eight Mile Rd., Oak Park, MI 48237, entitled "Roll Forming Equipment", 4 pages.

Advertisement of The Bradbury Company, Inc., of Air Industrial Park, Moundrige, KS 67107, entitled "Rafting Simplified by New Design From Bradbury", appearing in Modern Metals Magazine (p. 8).

New Article from the Journal of the Fabricator, vol. 8, No. 3, May/Jun., 1978 by David Bradbury of Bradbury Company, Inc. entitled "Eliminating Roll Tooling Changeover—Options and Solutions for Rollforming Multiple Parts to reduce Downtime", pp. 1, 10 and 11.

*Primary Examiner*—Daniel C. Crane

*Attorney, Agent, or Firm*—Cullen, Sloman, Cantor, Grauer, Scott & Rutherford

[57] ABSTRACT

The roll forming machine includes a base, a motor drive, a power transmission connected to the motor drive, a rafted roll form assembly including a raft plate and a plurality of vertically aligned power rotated longitudinally spaced pairs of complemental rolls, arranged in a set to successively and operatively receive and feed there between elongated strips of stock, and a gear train including a plurality of gears and a drive gear interconnecting the set of rolls. The transmission includes a drive shaft connected to a gear reduction box having a power rotated sleeve aligned with the drive gear of the gear train. In order to change the rafted roll form assembly including the raft plate and the set of complemental rolls carried by the raft plate to another roll form assembly for making another metal part, a quick disconnect structure is provided which includes a drive clutch on the drive gear of the gear train of the raft assembly. The structure includes a normally retracted reciprocal jaw clutch which is slidably keyed to the sleeve and rotatable therewith, and a motor includes a reciprocal member connected to the drive clutch for advancing it into drive engagement with the drive gear.

43 Claims, 3 Drawing Sheets

MACHINE WITH QUICK DISCONNECT BETWEEN SPINDLE DRIVE TRAIN AND POWER TRANSMISSION

FIELD OF INVENTION

A roll forming machine is used to make metal parts, starting with a coiled, flat strip of metal which is passed through a series of tandem aligned rolls that progressively cold form the final shape of the parts.

BACKGROUND OF THE INVENTION

In the past, a roll forming machine uses a plurality of vertically aligned power rotated longitudinally spaced pairs of complemental rolls and a gear train for rotating the rolls in unison. Such machines have included a motor drive with a power transmission connected thereto and with some means for connecting the transmission to the gear train for rotating all of the roll spindles in unison.

Previously for machines of this type, a series of rolls are mounted upon corresponding vertically aligned power rotated spaced pairs of spindles. Various efforts have been made for selectively transmitting power intermittently to the gear train for driving the spindles and connected rolls in unison in order to successively and opertively receive and feed therebetween elongated strips of stock.

In such machines, different forming operations require a different set of forming rolls. It has been necessary to modify or replace the opposed pairs of rolls that are arranged in a set or a plurality of sets along the bed of the machine. Considerable time and labor are required to replace the sets of rolls.

In U.S. Pat. No. 4,557,129, assigned to the assignee of record, a plurality of sets of multiple tool rolls have been provided with a turret mount therefore whereby up to four sets of rolls may be selectively presented as the feed path for the work pieces. Means are provided for incrementally rotating the turret and the corresponding multiple tooling in 90 degree segments so as to expose a different set of tooling for a different forming procedure.

Previously, with machines of this type and for a change in the tooling and for substituting one set of tooling for another set of tooling, a series of vertically aligned power rotated longitudinally spaced pairs of complemental spindles and rolls have been mounted upon a raft plate which is removably positioned upon the bed of the machine. The raft plate and its tooling may be replaced by other tooling mounted upon another raft plate by employing a suitable crane with a lift hook and chains. This provides another means by which the tooling of the machine can be rapidly changed without disturbing the setting of the first tooling.

SUMMARY OF THE INVENTION

An important feature of the present invention is to provide a machine with a bse which includes a motor drive and a power transmission connected thereto topgether with a plurality of vertically aligned power rotated longitudinally spaced pairs of complemental rolls arranged in a set to successively and operatively receive and feed therebetween elongated strips of stock. With such a construction a gear train is provided including a plurality of gears which interconnect a set of rolls or a set of spindles for rotation in unison and which include a drive gear having a clutch means thereon connected to the gears in the gear train. Such clutch means forms part of a quick disconnect structure or means to provide for a change in tooling.

Another feature is the provision of a normally retracted, reciprocal power-operated jaw clutch which is slidably keyed within the power rotated sleeve of a gear reduction box for selectively advancing the jaw clutch into drive engagement with the drive gear of the gear train and for retracting the jaw clutch for disengagement from the gear train. Such jaw clutch and associated components form the other part of the quick disconnect structure.

Still another feature is the provision of a plurality of vertically aligned power rotated longitudinally spaced pairs of complemental rolls arranged in a plurality of longitudinal sets, with a gear train provided for each set of rolls. Each gear train includes a drive gear with a clutch means thereon. The transmission includes an elongated drive shaft connected to a plurality of spaced gear reduction boxes corresponding to each set of rolls receiving the drive shaft. Each gear reduction box includes a power rotated output sleeve connected to the drive shaft and aligned with the drive gear in each gear train respectively. A normally retracted reciprocal jaw clutch is slidably keyed to each power sleeve and rotatable therewith. A pneumatic motor means is connected to each jaw clutch for simultaneously and selectively advancing the jaw clutch into drive engagement with the corresponding drive gear of each set of rolls.

A further feature is the mounting of the jaw clutch within the power rotated sleeve on the gear reduction box. The mounting includes an elongated tube slidably mounted within and keyed to the sleeve and at one end connected to the jaw clutch. The tube at its other end is connected to a motor means for selective reciprocal adjustments relative to the sleeve during rotation thereof.

Another feature is that the motor means connected to the jaw clutch includes a pneumatic cylinder having a reciprocal piston rod axially aligned with and swively connected to the jaw clutch. Such swivel connection includes a counterbore within the other end of the clutch tube within which is mounted and retained a bearing which receives the piston rod of the motor means. A fastener abuts the bearing and extends axially into the piston rod so that the jaw clutch tube is free for rotation relative to the piston rod.

These and other objects and features will be seen from the following Specification and Claims in conjunction with the appended drawings.

DRAWINGS

Figure 1:
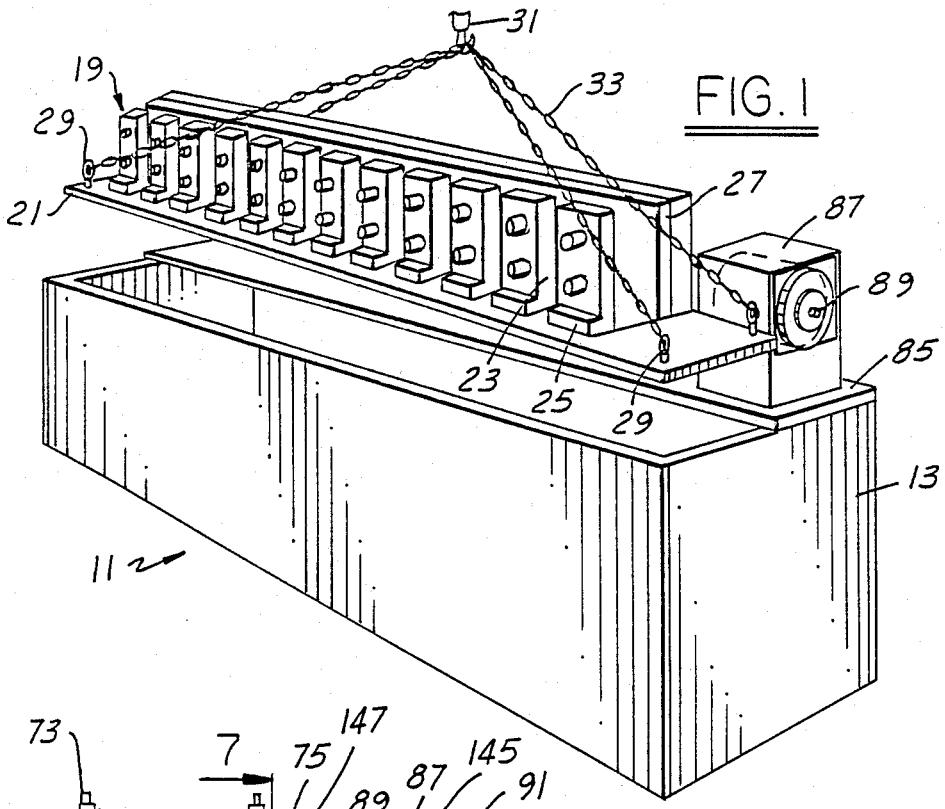
FIG. 1 is a perspective view of a roll forming machine which includes an elongated raft plate partly suspended by a crane hook, fragmentarily shown, and a series of chains above the base of the machine.

It will be understood that the above drawings illustrate merely a preferred embodiment of the invention, and that other embodiments are contemplated within the scope of the claims hereafter set forth.

DETAILED DESCRIPTION OF THE EMBODIMENT OF THE INVENTION

The machine, generally indicated at 11, is sometimes referred to herein as a roll machine or forming equipment or as a roll mill, though not limited to a roll forming process. The machine process includes a base 13 having a top plate 14, FIG. 4, and a base plate 15, FIG. 3, mountable upon floor surface 17. In one form of the present invention there is provided a rafted roll form assembly 19, such asshown in FIG. 1, partly suspended from base 13 and which includes an elongated raft plate 21. Mounted upon the raft plate 21 are a series of aligned longitudinally spaced stands 23, each with a right angular mount flange 25 secured to the raft plate 21 by fasteners 26. In the illustated embodiment twelve stations are schematically designated in FIG. 7. Also mounted in an upright position upon raft plate 21 is an elongated upright spindle mount plate 27, sometimes referred to as the main block.

A plurality of eye bolts 29 are mounted adjacent the respective corners of the raft plate 21. As a means of assembling or dismantling the rafted roll form assembly 19 from the machine base 13 there is employed a crane lift hook 31 suspended from a suitable crane, not shown, together with a plurality of chains 33. The chain 33 at their one ends are connected to the corresponding eye bolts 29 and a their other ends are connected to the crane lift hook 31. By this construction, the rafted roll form assembly 19, if employed, may be removed as a unit from base 13 and replaced with a different set of spindles and rolls upon a different raft plate for forming a different metal part.

Figures 4, 5, 6:
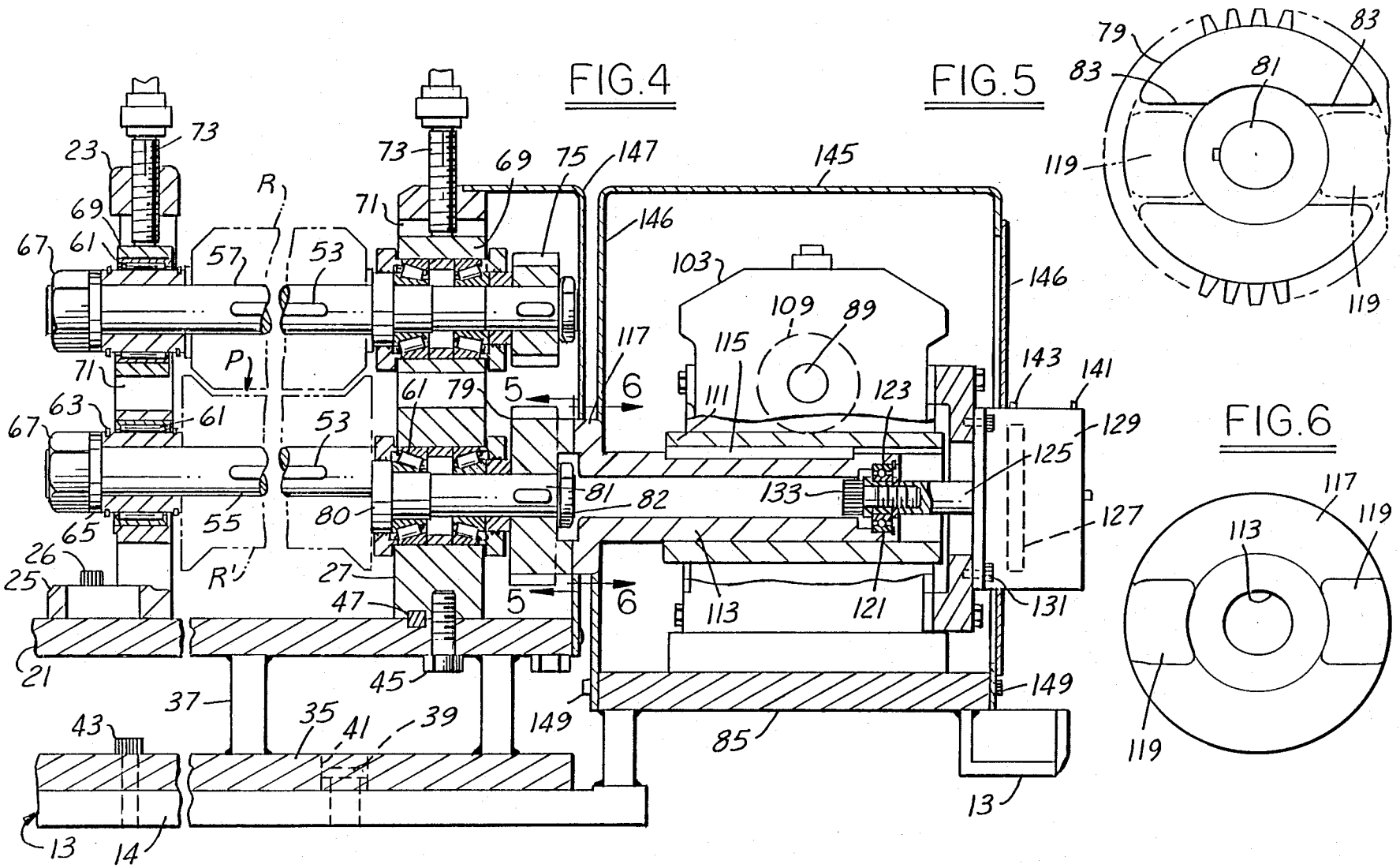
FIG. 4 is a transverse sectional view taken in the direction of arrows 4—4 of FIG. 3, and on an increased scale.
FIG. 5 is a fragmentary sectional view taken in the direction of arrows 5—5 of FIG. 4, and on an increased scale.
FIG. 6 is a sectional view taken in the direction of arrows 6—6 of FIG. 4, and on an increased scale.

In the illustrated embodiment shown in further detail, FIG. 4, mount plate 35 underlies and is secured to the raft plate 21 by a pair of parallel spacers 37 welded thereto. For the proper positioning of the rafted roll form assembly 19 upon the top plate 14 as in FIG. 4, a pair of laterally spaced locating pins 39 are mounted upon the top plate 14 and coopertively received within corresponding locating apertures 41 located within the mount plate 35. At least two fasteners 43 extend downwardly through mount plate 35 and into top plate 14 for removably securing the raft plate 21 in position on the base of the machine 11 during use.

The upright spindle mount plate 27 also referred to as a main block, is keyed as at 47 to the raft plate 21 and is secured thereto by a series of fasteners 45. Top roll R and bottom roll R′ are keyed as 53 to the corresponding lower spindle 55 and upper spindle 57, fragmentarily shown in FIG. 4.

Figure 7:
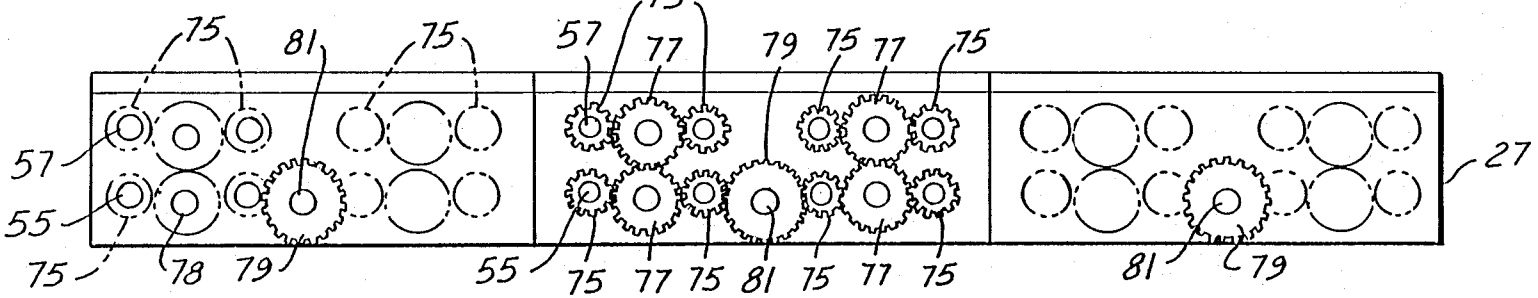
FIG. 7 is an elevational view taken in the direction of arrows 7—7 of FIG. 2 illustrating the plural sets of spindles and gear trains therefore.

A plurality of such vertically aligned, power-rotated, longitudinally spaced pairs of spindles 55 and 57, with complemental rolls keyed thereto, are arranged in a set or a plurality of sets such as shown in FIG. 7. The rolls are adapted to successively and operatively receive and feed therebetween elongated strips of stock, at the pass line P, FIG. 4. The respective vertically aligned pairs of longitudinally spaced spindles 55 and 57 are supported and journaled within suitable bearings 61. These may be roller bearings or tapered bearings with snap rings 63 thereon mounted within the corresponding series of upright stands 23 and retained thereon by spacers 65 and corresponding fasteners 67.

The opposite end portions of the respective spindles 55, 57 are supported on and extend through additional bearings 61, such as the tapered bearing shown, FIG. 4, and project through the main block 27.

The upper set of spindles 57 are adapted for vertical adjustments for regulating the vertical spacing between the spindles 55, 57. For this purpose, adjustably positioned within corresponding apertures 71 within the stands 23 and main block 27, are a plurality of apertured yokes 69 within which are mounted the upper set of bearings 61. Corresponding adjusting screws 73 are threaded downwardly through the respective stands 23 and corresponding main block 27 in supporting engagement with the corresponding yoke 69 for individual adjustment thereof within the slots 71, thereby adjusting the spacing between spindles 55 and 57.

Figure 2:
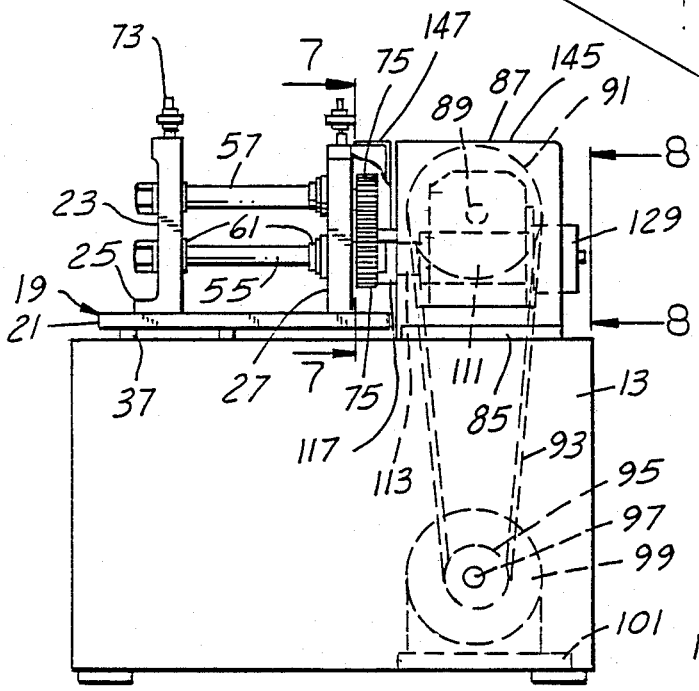
FIG. 2 is a side elevational view of the roll forming machine with the raft plate assembled upon the machine base.

The present power gear train for each of the three sets of spindles, FIG. 7, includes a spindle drive gear 75 secured upon one end of the corresponding upper and lower spindles 55 and 57, FIGS. 2, 4 and 7. The corresponding spindle drive gears 75 are in mesh with the laterally adjacent, vertically aligned enmeshed pairs of idler gears 77 located upon the stud shafts 78 which are mounted upon main block 27 in the manner shown in FIG. 7. Each set of spindles, as hereafter defined, includes in the illustrated embodiment four laterally spaced stands 23 and four pairs of vertically aligned, power-rotated spindles 55 adn 57 mounting the complemental rolls R and R′, FIG. 4. For each gear train centrally thereof there is provided a drive gear 79 which is in mesh with adjacent lower spindle drive gears 75. The drive gears 79 are movably mounted and keyed on stud shafts 81, FIGS. 4 and 7, and supported and journaled upon main block 27.

The assembly of the corresponding drive gear 79 as mounted upon the corresponding stud shaft 81 is retained by the corresponding fastener 82. In view of the flanged portion 80, the opposite ends of the bearing 61 are retained relative to the block 27 against longitudinal endwise movement. The outer surface of drive gear 79 includes a pair of laterally spaced clutch slots 83, sometimes referred to as clutch means, adapted for cooperative registry with corresponding clutch plates 119 upon the normally retacted reciprocal jaw clutch 117, as shown in FIGS. 4, 5 and 6.

Figure 3:
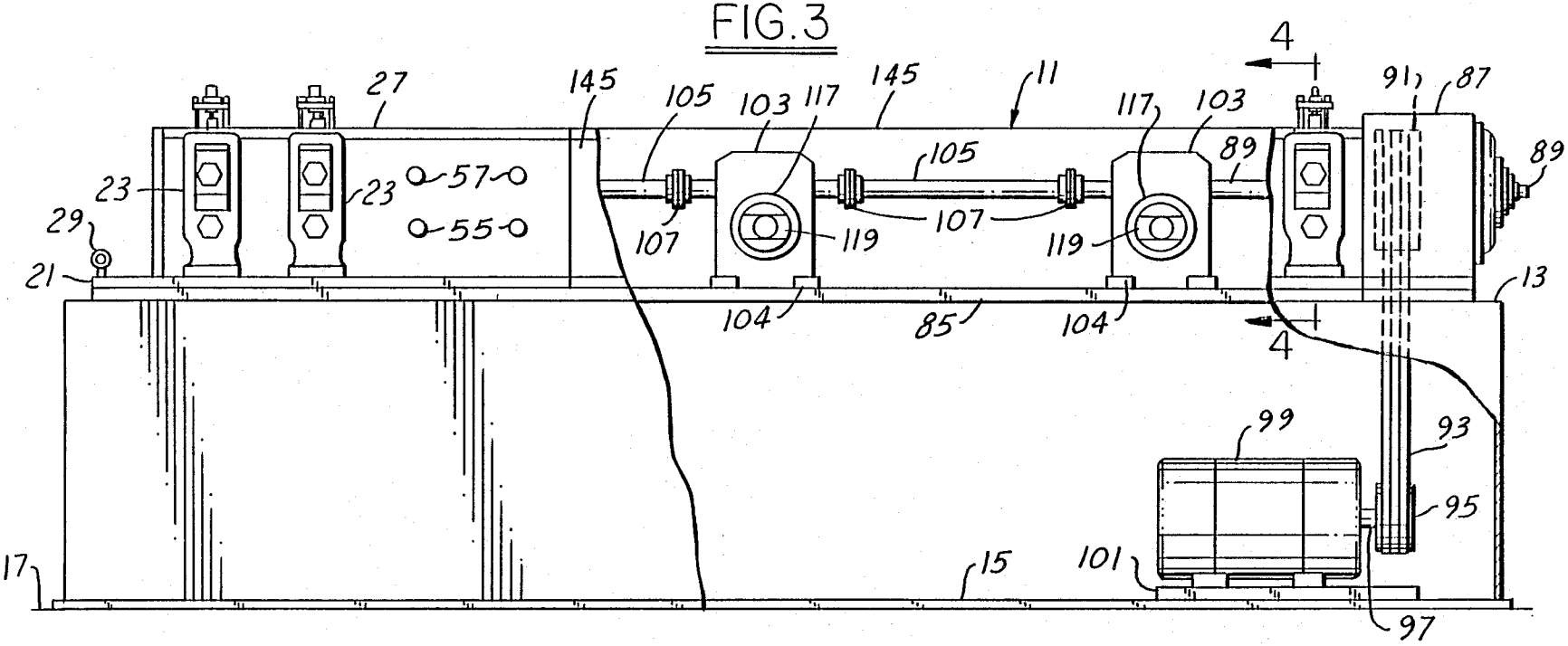
FIG. 3 is a front elevational view of the roll forming machine shown in FIG. 2 with portions broken away for illustration.

As shown in FIGS. 1, 2, 3 and 4, overlying base 13 is the elongated drive support plate 85 which is suitably secured thereto as by the welds and over which is positioned and retained the present power drive transmissions 87 anchored thereto. The power transmission housing includes an elongated drive shaft 89, FIGS. 3 and 4, which mounts a pair of pulleys 91. The pulleys 91 are connected by belts 93 to corresponding pulleys 95 located upon drive shaft 97 of motor 99, sometimes referred to as a motor drive. Motor support 101, FIG. 3, is mounted upon the base plate 15 and is suitably anchored thereto. This provides for the transmission of power drive to the transmission drive shaft 89.

A series of longitudinally spaced gear reduction boxes, sometimes referred to as worm gear reduction boxes 103, or the equivalent, are mounted upon base 13, and in the illustrated embodiment, upon the drive support plate 85. The corresponding drive shaft 89 extends through the adjacent worm gear reduction box 103 and the additional worm gear reduction boxes 103 including a series of shaft connector 105 and couplings 107.

In the illustrated embodiment, each of the respective gear reduction boxes 103 is adapted for providing rotative power to one of the corresponding three sets of gear trains, FIG. 7, and specifically the centrally arranged drive gear 79. In the illustrated embodiment, a suitable worm gear and worm wheel assembly 109, FIG. 4, transmits power from the rotative drive shaft 89 and its extensions 105 to the power rotated worm sleeves 111. The sleeves 111, FIG. 4, are axially aligned and spaced from the adjacent drive gear 79 of a corresponding set of rolls R′ and spindles 55. Slidably positioned within the power rotated sleeve 111, sometimes referred to as a worm sleeve, is a longitudinally reciprocal jaw clutch tube 113 with a suitable key 115 interposed therebetween. The power-rotated sleeve and the jaw clutch tube 113 are rotatable in unison. The jaw clutch tube 113, at one end, terminates in the jaw clutch 117, FIG. 4, which has a pair of transversely spaced drive plates or projections 119, sometimes referred to as clutch plates (FIG. 6). These are adapted for interlocking registry when advanced to the position shown in FIG. 4 within corresponding clutch slots 83 within the respective drive gears 79.

Though the jaw clutch 117 is shown in its advanced drive position, FIG. 4, with respect to drive gear 79, the jaw clutch 117 is normally in a retracted position spaced from drive gear 79. The opposite end of jaw clutch tube 113 terminates in a counterbore 121 within which is nested and retained by a suitable snap ring the bearings 123. Reciprocal piston rod 125 from the pneumatic cylinder assembly 129, sometimes referred to as motor means or pneumatic motor means, extends through the bearing 123 and is secured thereto by a connector 133.

The corresponding motor means or pneumatic motor 129 includes a suitable piston 127, shown in dashed lines in FIG. 4, reciprocally movable within cylinder 129, sometimes referred to as a pancake cylinder. The pneumatic cylinder 129 includes a pair of mount fasteners 131 for securing the cylinder assembly upon the mount plate 132 which is secured upon the adjacent gear reduction box 103. In the illustrated embodiment, there are three gear reduction boxes 103 and corresponding three-cylinder assemblies 129 with corresponding reciprocal piston rods 125 for controlling reciprocal movements of the respective jaw clutches 117 relative to each drive gear 79 and its clutch means or clutch slots 83, as shown in FIGS. 4, 5 and 6.

Figure 8:
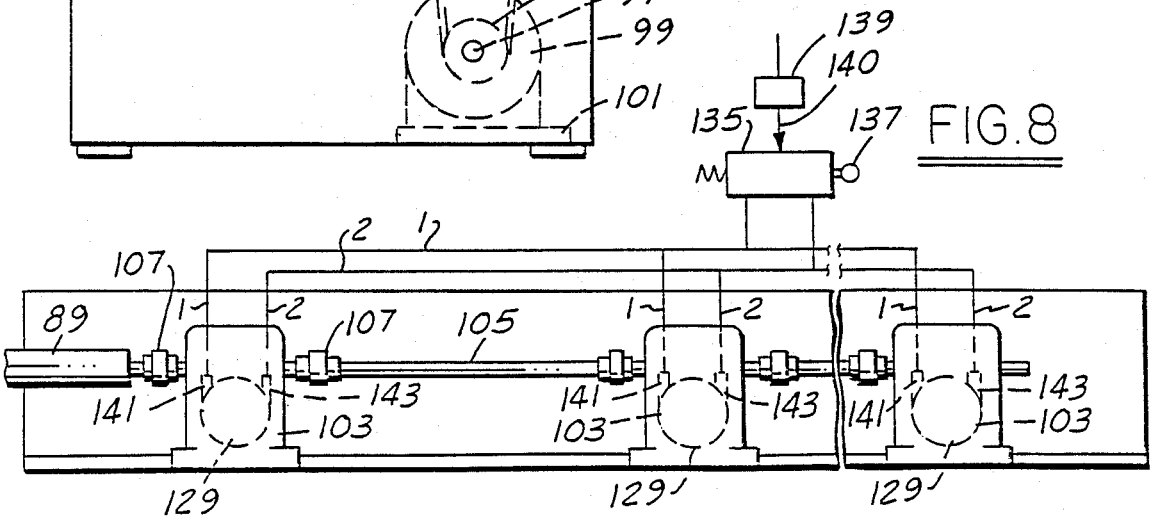
FIG. 8 is a fragmentary elevational view taken in the direction of arrows 8—8 of FIG. 2.

For the simultaneous control of the respective pneumatic cylinders 129 and corresponding pistons 127, there is provided a single four-way valve 135, schematically shown in FIG. 8, having a conventional reciprocal vavle element therein operated by the manual control lever 137. Pressure regulator 139, connected to a source of pressurized air, in the illustrated embodiment is set at 25–30 psi, approximately. The regulator 139 feeds air to the intake 140 of the four-way valve 135, which has a pair of outlets. One outlet is connected to the conduit 1 for connection to the respective fittings 141 of each of the pneumatic cylinders 129. The four-way valve 135 has an additional outlet connected to conduit 2 for connection to the second to fitting 143 on the respective pneumatic cylinders 129, as in FIGS. 4 and 8.

The respective cylinders 129 are simultaneously activated by four-way valve 135 and manual control lever 137.

The present cylinder 129 is sometimes referred to as a double-acting pancake air cylinder. A pressurized air supply is connected with the pressure regulator 139, set at 25–30 psi, approximately. When hand lever 137 at the four-way valve 135 is moved down, the connections from the four-way valve 135 to the corresponding fittings 142 move the corresponding piston rod 125 and connected tube 113 mounting the jaw clutch 117 into engagement with the clutch means or slots 83 located upon the drive gear 79 for each of the respective sets of spindles 55,57 and corresponding rolls, FIG. 7. When the lever 37 is moved to a second position such as up, it reverses the position of the valve element within the four-way valve 135 so that the second conduit 2 is pressurized for pressurizing the cylinder fittings 143 of the respective pneumatic cylinders 129 for simultaneously retracting the piston rods 125. The rods 125 are connected to the corresponding tubes 113 which mount at their ends the corresponding jaw clutches 117. Thus, moving the lever 137 down engages the jaw clutch 117, and moving the lever 137 up disengages the jaw clutch 117 from the corresponding spindle drive gear 79.

Housing 145 is provided for the power transmission which includes elongated drive shaft 89 and the extensions 105 thereof, the corresponding gear reduction boxes 103 as positioned upon the drive support plate 85. The housing 145 includes the opposed end plates 146, at their lower ends secured to opposite sides of the drive support plate 85 as by the fasteners 149, FIG. 4. The corresponding gear trains, FIGS. 4 and 7, are protectively enclosed by cover plate 147 and its depending rear wall which is spaced from the corresponding side wall 146 of the cover 145 of the power transmission.

This spacing provides a visual means for a person to look down through the slot of FIG. 4 between housings 145 and 147 and to observe whether the normally retracted reciprocal jaw clutch 117 is in engagement with drive gears 79 or is in a retracted positon within corresponding apertures within the adjacent side plates of the respective housings 145 and 147.

In the illustrated embodiment shown in FIG. 1, and wherein a rafted roll form assembly 19 is employed, a raft unit when used may be removed from the base 13 by first lifting the manual lever 137, FIG. 8, which operates air cylinder 129 to disengage the corresponding sliding jaw clutches 117 from the roll shaft drive gears 79. As a second step, the two socket-headed screws 43, FIG. 4, one of which is shown, which fasten the raft unit or assembly 19 to the base 13, are first removed. Using the eyebolts 29, chains 33 and the lift hook 31 from a suitable crane, not shown, the unit rafted roll form assembly 19 may be lifted from base 13 and transported therefrom.

In order to mount raft unit 19 upon base 13, the corresponding eyebolts, chains 33 and life hook are employed. Mount plate 35 is lowered till its locating apertures receive locating pins 39. Fasteners 43 are applied, FIG. 4, to anchor mount plate 35 upon top plate 14. Thereafter lever 137 is moved down causing jaw clutches 117 to engage drive gears 79. When the roll mill 11 is started the jaw clutches 117 automatically operate the drive gears 79.

Having described our invention reference should now be had to the following claims.

We claim:

1. In a machine having a base, a support plate upon the base, a motor drive, a power driven transmission mounted upon the support plate and connected to the motor drive, a plurality of vertically aligned power rotated longitudinally spaced pairs of complemented rolls, arranged in a set to successively and operatively receive and feed therebetween elongated strips of stock;

the improvement comprising a gear train including a plurality of gears interconnecting the rolls of said set of rolls for rotation in unison, and including a drive gear with a clutch means thereon connected to the gears in said gear train;

said transmission including an elongated drive shaft laterally spaced from said rolls;

a gear reduction box mounted upon said support plate and receiving said drive shaft;

said gear reduction box including a power rotated output sleeve connected to the drive shaft and aligned with the drive gear in said gear train;

a normally retracted reciprocal jaw clutch slidably keyed within said sleeve and rotatable therewith; and motor means connected to said jaw clutch for selectively advancing said jaw clutch into driving engagement with said drive gear and for alternately retracting said jaw clutch;

the mounting of said jaw clutch within said power rotated sleeve including an elongate tube slidably mounted within and keyed to said shaft for rotation in unison and at one axial extent connected to said jaw clutch;

said tube at its other axial extent being connected to said motor means for selected reciprocal adjusmtents relative to said sleeve during rotation thereof.

2. In the machine of claim 1, said base having a base plate and a top plate;

said motor drive being mounted upon the base plate; and said rolls being mounted upon the top plate.

3. In the machine of claim 1, the connection of the transmission to said motor drive including a drive shaft upon said motor drive;

first pulleys secured upon sid motor drive shaft;

second pulleys secured upon said transmission drive shaft; and belts interconnecting said first and second pulleys for rotation in unison.

4. In the machine of claim 1, said clutch means and said jaw clutch including in one of said clutch means and jaw clutch a pair of spaced grooves and within the other thereof a pair of opposed clutch plates nested within said grooves.

5. In the machine of claim 1, the connection between said transmission drive shaft and said output sleeve including a worm wheel and worm gear assembly within said gear reduction box.

6. In a machine having a base, a support plate upon the base, a motor drive, a power drive transmission mounted upon the support plate and connected to the motor drive, a plurality of vertically aligned power rotated longitudinally spaced pairs of complemental rolls, arranged in a set to successively and operatively receive and feed therebetween elongated strips of stock;

the improvement comprising a gear train including a plurality of gears interconnecting the rolls of said set of rolls for rotation in unison, and including a drive gear with a clutch means thereon connected to the gears in said gear train;

said transmission including an elongated drive shaft laterally spaced from said rolls;

a gear reduction box mounted upon said support plate and receiving said drive shaft;

said gear reduction box including a power rotated output sleeve connected to the drive shaft and aligned with the drive gear in said gear train;

a normally retracted reciprocal jaw clutch slidably keyed within said sleeve and rotatable therewith;

motor means connected to said jaw clutch for selectively advancing said jaw clutch into driving engagement with said drive gear and for alternately retracting said jaw clutch;

said base including a top plate;

an elongated raft plate overlying and extending along said top plate;

an upright main block mounted upon said raft plate and secured thereto;

a plurality of longitudinally spaced upright stands corresponding to each pair of rolls mounted upon said raft plate, arranged in a row spaced from and parallel to said main block;

said stands and main block supportively receiving and journaling said pairs of rolls;

a pair of spaced upstanding locating pins mounted upon said top plate in cooperative registry within a corresponding pair of locating apertures in said raft plate; and a plurality of fasteners securing said raft plate to said top plate, whereby said rolls, block, stand sand gear train may be successively assembled as a unit onto and removed from said base.

7. In the machine of claim 6, eyebolts secured adjacent the corners of said raft plate;

a vertically adjustable and transportable crane lift hook centrally overyling said raft plate; and a plurality of chains at their one ends connected to each eyebolt respectively and at their other ends connected to said crane lift hook, whereby the raft plate may be transported to and from said base for selective positioning thereon.

8. In the machine of claim 6, the mounting of said pairs of rolls including vertically aligned longitudinally spaced pairs of upper and lower spindles axially extending through and keyed to said rolls respectively, and extending through and journaled upon said stands and main block.

9. In the machine of claim 8, a gear from said gear train being secured upon each spindle outwardly of said main block;

said gear train further including spaced pairs of vertically aligned meshing idler gears journaled upon said main block and further meshed with laterally adjacent spindle gears respectively whereby rotation of said drive gear effects simultaneous rotation of all spindles in said set.

10. In the machine of claim 8, the mounting of each of said upper spindles including opposed apertured yokes adjustably and guidably mounted within and upon each stand and upon said main block journaling and supporting the outer ends of said upper spindles; and an adjustable screw means threaded upon each stand and into said main block supportively mounting said blocks respectively for individually adjusting said yokes for modifying the center distance between each pair of spindles.

11. In a machine having a base, a support plate upon the base, a motor drive, a power drive transmission mounted upon the support plate and connected to the motor drive, a plurality of vertically aligned power rotated longitudinally spaced pairs of complemental rolls, arranged in a set to successively and operatively receive and feed therebetween elongated strips of stock;

the improvement comprising a gear train including a plurality of gears interconnecting the rolls of said set of rolls for rotation in unison, and including a drive gear with a clutch means thereon connected to the gears in said gear train;

said transmission including an elongated drive shaft laterally spaced from said rolls;

a gear reduction box mounted upon said support plate and receiving said drive shaft;

said gear reduction box including a power rotated output sleeve connected to the drive shaft aligned with the drive gear in said gear train;

a normally retracted reciprocal jaw clutch slidably keyed within said sleeve and rotatable therewith;

motor means connected to said jaw clutch for selectively advancing said jaw clutch into driving engagement with said drive gear and for alternately retracting said jaw clutch;

said base including a top plate;

an elongated raft plate overlying and extending along said top plate;

an upright main block mounted upon said raft plate and secured thereto;

a plurality of longitudinally spaced upright stands corresponding to each pair of rolls mounted upon said raft plate, arranged in a row spaced from and parallel to said main block;

said stands and main block supportively receiving and journaling said pairs of rolls;

a mount plate spaced from an underlying said raft plate and mounted upon said top plate;

elongated spacers rigidly interconnecting said raft and mount plates;

a pair of spaced upstanding locating pins mounted upon said top plate, in cooperative registry within a pair of similarly spaced locating apertures in said mount plate; and a plurality of fasteners securing said mount plate to said top plate whereby said raft plate and mount plate, rolls, gear train, block and stands may be successively assembled as a unit onto and removed from said base.

12. In a machine having a base, a support plate upon the base, a motor drive, a power drive transmission mounted upon the support plate and connected to the motor drive, a plurality of vertically aligned power rotated longitudinally spaced pairs of complemental rolls, arranged in a set to successively and operatively receive and feed therebetween elongated strips of stock;

the improvement comprising a gear train including a plurality of gears interconnecting the rolls of said set of rolls for rotation in unison, and including a drive gear with a clutch means thereon connected to the gears in said gear train;

said transmission including an elongated drive shaft laterally spaced from said rolls;

a gear reduction box mounted upon said support plate and receiving said drive shaft;

said gear reduction box including a power rotated output sleeve connected to the drive shaft and aligned with the drive gear in said gear train;

a normally retracted reciprocal jaw clutch slidably keyed within said sleeve and rotatable therewith;

motor means connected to said jaw clutch for selectively advancing said jaw clutch into driving engagement with said drive gear and for alternately retracting said jaw clutch;

said motor including a pneumatic cylinder mounted upon said base having a reciprocal piston rod axially aligned with and swively connected to said jaw clutch, said jaw clutch being rotatable relative to said piston rod.

13. In the machine of claim 12, said swivel connection including an elongated tube slidably mounted within said sleeve and keyed thereto for rotation in unison, and at one end connected to said clutch, there being a counterbore at the other end of said tube;

a bearing nested and retained within said counterbore axially receiving said piston rod; and a fastener axially abutting said bearing and threaded into said piston rod.

14. In the machine of claim 12, said cylinder having a pair of pressure fittings;

a four way manual valve having an air intake connectable to a source of pressurized air and a pair of outlets connected to said fittings respectively for selectively advancing and retracting said piston rod; and a manual lever connected to said valve, with movement in one direction adjusting the valve for advancing said piston rod, engaging the jaw clutch with said roll drive gear, and movable in the opposite direction for reversing said valve and retracting said piston rod and disengaging the jaw clutch from the roll drive gear.

15. In the machine of claim 14, said source of pressurized air including a pressure regulator set at 25 to 30 pounds psi approximately.

16. In a machine having a base, a support plate upon the base, a motor drive, a power drive transmission mounted upon the support plate and connected to the motor drive, a plurality of vertically aligned power rotated longitudinally spaced pairs of complemental rolls, arranged in a set to successively and operatively receive and feed therebetween elongated strips of stock;

the improvement comprising a gear train including a plurality of gears interconnecting the rolls of said set of rolls for rotation in unison, and including a drive gear with a clutch means thereon connected to the gears in said gear train;

said transmission including an elongated drive shaft laterally spaced from said rolls;

a gear reduction box mounted upon said support plate and receiving said drive shaft;

said gear reduction box including a power rotated output sleeve connected to the drive shaft and aligned with the drive gear in said gear train;

a normally retracted reciprocal jaw clutch slidably keyed within said sleeve and rotatable therewith;

motor means connected to said jaw clutch for selectively advancing said jaw clutch into driving engagement with said drive gear and for alternately retracting said jaw clutch;

the mounting of the jaw clutch within said power rotated sleeve including an elongated tube slidably mounted within and keyed to said sleeve for rotation in unison and at one end connected to said jaw clutch;

said tube at its other end being connected to said motor means for selected reciprocal adjustments relative to said sleeve during rotation thereof;

said motor means including a pneumatic cylinder mounted upon said base having a reciprocal piston rod axially aligned with and swively connected to said tube, said swivel connection including a counterbore at the other end of said tube;

a bearing nested and retained within said counterbore axially receiving said piston rod; and a fastener axially abutting said bearing and threaded into said piston

17. In the machine of claim 16, said cylinder being mounted upon said gear reduction box.

18. In a machine having a base, a support plate upon the base, a motor drive, a power drive transmission mounted upon the support plate and connected to the motor drive, a plurality of vertically aligned power rotated longitudinally spaced pairs of complemental rolls, arranged in a plurality of longitudinal sets to successively and operatively receive and feed therebetween elongated strips of stock;

the improvement comprising a plurality of gear trains, each gear train including a plurality of gears interconnecting the rolls of each set of rolls for rotation in unison, and including a drive gear with a clutch means thereon connected to the gears in each gear train;

said transmission including an elongated drive shaft laterally spaced from and extending at right angles to said rolls;

a plurality of spaced gear reduction boxes mounted upon and support plate corresponding to each set of rolls and receiving said drive shaft;

each gear reduction box including a power rotated output sleeve connected to the drive shaft and aligned with the drive gear in each gear train respectively;

a normally retracted reciprocal jaw clutch slidably keyed within said sleeve and rotatable therewith; and motor means connected to said jaw clutch for selectively advancing said jaw clutch into drive engagement with a corresponding drive gear; said motor means extending axially through the end of said sleeve opposite the jaw clutch.

19. In the machine of claim 18, the mounting of the jaw clutch within said power rotated sleeve including an elongated tube slidably mounted within and keyed to said sleeve for rotation in unison and at one end connected to said jaw clutch;

said tube at its other end being connected to said motor means for selected reciprocal adjustments relative to said sleeve during rotation thereof.

20. In a machine having a base, a support plate upon the base, a motor drive, a power drive transmission mounted upon the support plate and connected to the motor drive, a plurality of vertically aligned power rotated longitudinally spaced pairs of complemental rolls, arranged in a plurality of longitudinal sets to successively and operatively receive and feed therebetween elongated strips of stock;

the improvement comprising a plruality of gear trains, each gear train including a plurality of gears interconnecting the rolls of each set of rolls for rotation in unison, and including a drive gear with a clutch means thereon connected to the gears in each gear train;

said transmission including an elongated drive shaft laterally spaced from and extending at right angles to said rolls;

a plurality of spaced gear reduction boxes mounted upon and support plate corresponding to each set of rolls and receiving said drive shaft;

each gear reduction box including a power rotated output sleeve connected to the drive shaft and aligned with the drive gear in each gear train respectively;

a normally retracted reciprocal jaw clutch slidably keyed within said sleeve and rotatable therewith;

motor means connected to said jaw clutch for selectively advancing said jaw clutch into drive engagement with a corresponding drive gear;

said base including a top plate;

an elongated raft plate overlying and extending along said top plate;

an upright main block mounted upon said raft plate and secured thereto;

a plurality of longitudinally spaced upright stands corresponding to each pair of rolls mounted upon said raft plate, arranged in a row spaced from and parallel to said main block;

said stands and main block supportively receiving and journaling said pairs of rolls;

a pair of spaced upstanding locating pins mounted upon said top plate in cooperative registry within a corresponding pair of locating apertures in said raft plate; and a plurality of fasteners securing said raft plate to said top plate, whereby said rolls, block, stands and gear trains may be successively assembled as a unit onto and removed from said base.

21. In the machine of claim 20, eyebolts secured adjacent the corners of said raft plate;

a vertically adjustable and transportable crane lift hook centrally overyling said raft plate; and a plurality of chains at their one ends connected to each eyebolt respectively and at their other ends connected to said crane lift hook, whereby the raft plate may be transported to and from said base for selective positioning thereon.

22. In the machine of claim 20, the mounting of said pairs of rolls including vertically aligned longitudinally spaced pairs of upper and lower spindles axially extending through and keyed to said rolls respectively, and extending through and journaled upon said stands and main block.

23. In the machine of claim 22 a gear from said gear train being secured upon each spindle outwardly of said main block;

each of said gear trains further including spaced pairs of vertically aligned meshing idler gears journaled upon said main block and further meshed with laterally adjacent spindle gears respectively whereby rotation of all spindles in each set of rolls.

24. In the machine of claim 22 the mounting of each of said upper spindles including opposed apertured yokes adjustably and guidably mounted within and upon each stand and upon said main block journaling and supporting the outer ends of said upper spindles; and an adjustable screw means threaded upon each stand and into said main block supportively mounting said blocks respectively for individually adjusting said yokes for modifying the center distance between each pair of spindles.

25. In a machine having a base, a support plate upon the base, a motor drive, a power drive transmission mounted upon the support plate and connected to the motor drive, a plurality of vertically aligned power rotated longitudinally spaced pairs of complemental rolls, arranged in a plurality of longitudinal sets to successively and operatively receive and feed therebetween elongated strips of stock;

the improvement comprising a plurality of gear trains, each gear train including a plurality of gears interconnecting the rolls of each set of rolls for rotation in unison, and including a drive gear with a clutch means thereon connected to the gears in each gear train;

said transmission including an elongated drive shaft laterally spaced from and extending at right angles to said rolls;

a plurality of spaced gear reduction boxes mounted upon and support plate corresponding to each set of rolls and receiving said drive shaft;

each gear reduction box including a power rotated output sleeve connected to the drive shaft and aligned with the drive gear in each gear train respectively;

a normally retracted reciprocal jaw clutch slidably keyed within said sleeve and rotatable therewith;

motor means connected to said jaw clutch for selectively advancing said jaw clutch into drive engagement with a corresponding drive gear;

said base including a top plate;

an elongated raft plate overlying and extending along said top plate;

an upright main block mounted upon said raft plate and secured thereto;

a plurality of longitudinally spaced upright stands corresponding to each pair of rolls mounted upon said raft plate, arranged in a row spaced from and parallel to said main block;

said stands and main block supportively receiving and journalling said pairs of rolls;

a mount plate spaced from an underlying said raft plate and mounted upon said top plate;

elongated spacers rigidly interconnecting said raft and mount plates;

a pair of spaced upstanding locating pins mounted upon said top plate, in cooperative registry within a pair of similarly spaced locating apertures in said mount plate; and a plurality of fasteners securing said mount plate to said top plate whereby said raft plate and mount plate, rolls, gear trains, block and stand may be successively assembled as a unit onto and removed from said base.

26. In a machine having a base, a support plate upon the base, a motor drive, a power drive transmission mounted upon the support plate and connected to the motor drive, a plurality of vertically aligned power rotated longitudinally spaced pairs of complemental rolls, arranged in a plurality of longitudinal sets to successively and operatively receive and feed therebetween elongated strips of stock;

the improvement comprising a plurality of gear trains, each gear train including a plurality of gears interconnecting the rolls of each set of rolls for rotation in unison, and including a drive gear with a clutch means thereon connected to the gears in each gear train;

said transmission including an elongated drive shaft laterally spaced from an extending at right angles to said rolls;

a plurality of spaced gear reduction boxes mounted upon and support plate corresponding to each set of rolls and receiving said drive shaft;

each gear reduction box including a power rotated output sleeve connected to the drive shaft and aligned with the drive gear in each gear train respectively;

a normally retracted reciprocal jaw clutch slidably keyed within said sleeve and rotatable therewith;

motor means connected to said jaw clutch for selectively advancing said jaw clutch into drive engagement with a corresponding drive gear;

said motor means including a pneumatic cylinder mounted upon said base having a reciprocal piston rod axially aligned with and swively connected to said jaw clutch, said jaw clutch being rotatable relative to said piston rod.

27. In the machine of claim 26, said swivel connection including an elongated tube slidably mounted within said sleeve and keyed thereto for rotation in unison, and at one end connected to said clutch, there being a counterbore at the other end of said tube;

a bearing nested and retained wtihin said counterbore axially receiving said piston rod; and a fastener axially abutting said bearing and threaded into said piston rod.

28. In the machine of claim 26, said cylinder having a pair of pressure fittings;

a four way manual valve having an air intake connectable a source of pressurized air and a pair of outlets connected to said fittings respectively for selectively advancing and retracting said piston rod; and a manual lever connected to said valve, with movement in one direction adjusting the valve for advancing said piston rod, engaging the jaw clutch with said roll drive gear, and movable in the opposite direction for reversing said valve and retracting said piston rod and disengaging the jaw clutch from the roll drive gear.

29. In a machine having a base, a support plate upon the base, a motor drive, a power drive transmission mounted upon the support plate and connected to the motor drive, a plurality of vertically aligned power rotated longitudinally spaced pairs of complemental rolls, arranged in a plurality of longitudinal sets to successively and operatively receive and feed therebetween elongated strips of stock;

the improvement comprising a plurality of gear trains, each gear train including a plurality of gears interconnecting the rolls of each set of rolls for rotation in unison and including a drive gear with a clutch means thereon connected to the gears in each gear train;

said transmission including an elongated drive shaft laterally spaced from and extending at right angles to said rolls;

a plurality of spaced gear reduction boxes mounted upon and support plate corresponding to each set of rolls and receiving said drive shaft;

each gear reduction box including a power rotated output sleeve connected to the drive shaft and aligned with the drive gear in each gear train respectively;

a normally retracted reciprocal jaw clutch slidably keyed within said sleeve and rotatable therewith;

motor means connected to said jaw clutch for selectively advancing said jaw clutch into drive engagement with a corresponding drive gear;

said motor means including a pneumatic cylinder mounted upon said base having a reciprocal piston rod axially aligned with and swively connected to said tube, and swivel connection including a counterbore at the other end of said tube;

a bearing nested and retained within said counterbore axially receiving said piston rod; and a fastener axially abutting said bearing and threaded into said piston rod.

30. In a roll forming machine having a base, and a support plate upon the base, a motor drive, a power drive transmission mounted upon the support plate and connected to the motor drive, a plurality of vertically aligned power rotated longitudinally spaced pairs of complemental forming rolls, arranged in a a plurality of longitudinal sets to successively and operatively receive and feed therebetween elongated strips of stock;

the improvement comprising a plurality of gear trains, each gear train including a plurality of gears interconnecting the rolls of each set of rolls for rotation in unison, and including a drive gear with a clutch means thereon connected to the gears in each gear train;

said transmission including an elongated drive shaft laterally spaced from and extending at right angles to said rolls;

a plurality of spaced gear reduction boxes mounted upon said base corresponding to each set of rolls and receiving said drive shaft;

each gear reduction box including a power rotated output sleeve connected to the drive shaft and aligned with the drive gear in each gear train respectively;

a normally retracted reciprocal jaw clutch slidably keyed within said sleeve and rotatable therewith; and motor means connected to said jaw clutch for selectively moving said jaw clutch into driving engagement with a corresponding drive gear and normally retaining said jaw clutch in a retracted position;

said motor means extending axially through the end of said sleeve opposite said jaw clutch.

31. In a machine having a base, a motor drive, a power drive transmission, a plurality of vertically aligned power rotated longitudinally fixed spaced pairs of spindles mounting complemental rolls, arranged in a set to successively and operatively receive and feed therebetween elongated strips of stock;

the improvement comprising a gear train including a plurality of gears interconnecting the set of spindles for rotation in unison, and including a drive gear with a clutch means connected to said gear train;

said transmission including a drive shaft;

a gear reduction box receiving said drive shaft;

said gear reduction box including a power rotated output sleeve connected to the drive shaft and aligned with said drive gear;

a normally retracted reciprocal jaw clutch slidably keyed within said sleeve and rotatable therewith; said jaw clutch being in nondriving engagement with said drive gear in its normally retractive position; and motor means connected to said jaw clutch for selectively moving said jaw clutch relative to said longitudinally fixed rolls from its normally retracted position into drive engagement with said drive gear.

32. In the machine of claim 31, the mounting of the jaw clutch within said power rotated sleeve including an elongated tube slidably mounted within and keyed to said sleeve for rotation in unison and at one end connected to said jaw clutch;

said tube at its other end being connected to said motor means for selected reciprocal adjustments relative to said sleeve during rotation thereof.

33. In the machine of claim 31, the mounting of said pairs of rolls including vertically aligned longitudinally spaced pairs of upper and lower spindles axially extending through and keyed to said rolls respectively, and extending through and journaled upon said stands and main block.

34. In the machine of claim 33, a gear from said gear train being secured upon each spindle outwardly of said main block;

said gear train further including spaced pairs of vertically aligned meshing idler gears journaled upon said main block and further meshed with laterally adjacent spindle gears respectively whereby rotation of said drive gear effects simultaneous rotation of all spindles in said set.

35. In the machine of claim 33, the mounting of each of said upper spindles including opposed apertured yokes adjustably and guidably mounted within and upon each stand and upon said main block journaling and supporting the outer ends of said upper spindles; and an adjustable screw means threaded upon each stand and into said main block supportively mounting said blocks respectively for individually adjusting said yokes for modifying the center distance between each pair of spindles.

36. In the machine of claim 31, the mounting of the jaw clutch within said power rotated sleeve incluidng an elongate member slidably mounted within and keyed to said sleeve for rotation in unison and at one axial extent connected to said jaw clutch;

said member at its other axial extent being connected to said motor.

37. In a machine having a base, a motor drive, a power drive transmission, a plurality of vertically aligned power rotated longitudinally spaced pairs of spindles mounting complemental rolls, arranged in a set to successively and operatively receive and feed therebetween elongated strips of stock;

the improvement comprising a gear train including a plurality of gears interconnecting the set of spindles for rotation in unison, and including a drive gear with a clutch means connected to said gear train;

said transmission including a drive shaft;

a gear reduction box receiving said drive shaft;

said gear reduction box including a power rotated output sleeve connected to the drive shaft and aligned with said drive gear;

a normally retracted reciprocal jaw clutch slidably keyed within said sleeve and rotatable therewith;

motor means connected to said jaw clutch for selectively moving aid jaw clutch into drive engagement with said drive gear;

said base including a top plate;

an elongated raft plate overlying and extending along said top plate;

an upright main block mounted upon said raft plate and secured thereto;

a plurality of longitudinally spaced upright stands corresponding to each pair of rolls mounted upon said raft plate, arranged in a row spaced from and parallel to said main block;

said stands and main block supportively receiving and journaling said pairs of rolls;

a pair of spaced upstanding locating pins mounted upon said top plate in cooperative registry within a corresponding pair of locating apertures in said raft plate; and a plurality of fasteners securing said raft plate to said top plate, whereby said rolls, block, stands and gear train may be successively assembled as a unit onto and removed from said base.

38. In the machine of claim 37, eyebolts secured adjacent the corners of said raft plate;

a vertically adjustable and transportable crane lift hook centrally overlying said raft plate; and a plurality of chains at their one ends connected to each eyebolt respectively and at their other ends connected to said crane lift hook, whereby the raft plate maybe transported to and from said base for selective positioning thereon.

39. In a machine having a base, a motor drive, a power drive transmission, a plurality of vertically aligned power rotated longitudinally spaced pairs of spindles mounting complemental rolls, arranged in a set to successively and operatively receive and feed therebetween elongated strips of stock;

the improvement comprising a gear train including a plurality of gears interconnecting the set of spindles for rotation in unison, and including a drive gear with a clutch means connected to said gear train;

said trnsmission including a drive shaft;

a gear reduction box receiving said drive shaft;

said gear reduction box including a power rotated output sleeve connected to the drive shaft and aligned with said drive gear;

a normally retracted reciprocal jaw clutch slidably keyed within said sleeve and rotatable therewith;

motor means connected to said jaw clutch for selectively moving said jaw clutch into drive engagement with said drive gear;

said base including a top plate;

an elongated raft plate overlying and extending along said top plate;

an upright main block mounted upon said raft plate and secured thereto;

a plurality of longitudinally spaced upright stands corresponding to each pair of rolls mounted upon said raft plate, arranged in a row spaced from and parallel to said main block;

said stands and main block supportively receiving and journaling said pairs of rolls;

a mount plate spaced from and underlying said raft plate and mounted upon said top plate;

elongated spacers rigidly interconnecting said raft and mount plates;

a pair of spaced upstanding locating pins mounting upon said top plate, in cooperative registry within a pair of similarly spaced locating apertures in said mount plate; and a plurality of fasteners securing said mount plate to said top plate whereby said raft plate and mount plate, rolls, gear train, block and stands may be successively assembled as a unit onto and removed from said base.

40. In a machine having a base, a motor drive, a power drive transmission, a plurality of vertically aligned power rotated longitudinally spaced pairs of spindles mounting complemental rolls, arranged in a set to successively and opertively receive and feed therebetween elongated strips of stock;

the improvement comprising a gear train including a plurality of gears interconnecting the set of spindles for rotation in unison, and including a drive gear with a clutch means connected to said gear train;

said transmission including a drive shaft;

a gear reduction box receiving said drive shaft;

said gear reduction box including a power rotated output sleeve connected to the drive shaft and aligned with said drive gear;

a normally retracted reciprocal jaw clutch slidably keyed within said sleeve and rotatable therewith;

motor means connected to said jaw clutch for selectively moving said jaw clutch into drive engagement with said drive gear;

said motor means including a pneumatic cylinder mounted upon said base having a reciprocal piston rod axially aligned with and swively connected to said jaw clutch, said jaw clutch being rotatable relative to said piston rod.

41. In the machine of claim 40, said swivel connection including an elongated tube slidably mounted within said sleeve and keyed thereto for rotation in unison, and at one end connected to said clutch, there being a counterbore at the other end of said tube;

a bearing nested and retained within said counterbore axially receiving said piston rod; and a fastener axially abutting said bearing and threaded into said piston

42. In the machine of claim 40, said cylinder having a pair of pressure fittings;

a four way manual valve having an air intake connectable to a source of pressurized air and a pair of outlets connected to said fittings respectively for selectively advancing and retracting said piston rod; and a manual lever connected to said valve, with movement in one direction adjusting the valve for advancing said piston rod, engaging the jaw clutch with said roll drive gear, and movable in the opposite direction for reversing said valve and retracting said piston rod and disengaging the jaw clutch from the roll drive gear.

43. In a machine having a base, a motor drive, a power drive transmission, a plurality of vertically aligned power rotated longitudinally spaced pairs of spindles mounting complemental rolls, arranged in a set to successively and operatively receive and feed therebetween elongated strips of stock;

the improvement comprising a gear train including a plurality of gears interconnecting the set of spindles for rotation in unison, and including a drive gear with a clutch means connected to said gear train;

said transmission including a drive shaft;

a gear reduction box receiving said drive shaft;

said gear reduction box including a power rotated output sleeve connected to the drive shaft and aligned with said drive gear;

a normally retracted reciprocal jaw clutch slidably keyed within said sleeve and rotatable therewith;

motor means connected to said jaw clutch for selectively moving said jaw clutch into drive engagement with said drive gear;

said motor means including a pneumatic cylinder mounted upon said base having a reciprocal piston rod axially aligned with and swively connected to said tube, and swivel connection including a counterbore at the other end of said tube;

a bearing nested and retained within said counterbore axially receiving said piston rod; and a fastener axially abutting said bearing and threaded into said piston rod.

* * * * *